US011085642B2

(12) United States Patent
Tamura et al.

(10) Patent No.: US 11,085,642 B2
(45) Date of Patent: Aug. 10, 2021

(54) COMBUSTOR WITH RADIALLY VARYING LEADING END PORTION OF BASKET AND GAS TURBINE

(71) Applicant: Mitsubishi Hitachi Power Systems, Ltd., Kanagawa (JP)

(72) Inventors: Issei Tamura, Tokyo (JP); Keijiro Saito, Tokyo (JP); Kenji Miyamoto, Tokyo (JP); Yaohua Xue, Tokyo (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 29 days.

(21) Appl. No.: 16/302,989

(22) PCT Filed: May 23, 2017

(86) PCT No.: PCT/JP2017/019278
§ 371 (c)(1),
(2) Date: Nov. 19, 2018

(87) PCT Pub. No.: WO2017/204229
PCT Pub. Date: Nov. 30, 2017

(65) Prior Publication Data

US 2019/0293292 A1 Sep. 26, 2019

(30) Foreign Application Priority Data

May 23, 2016 (JP) ..... JP2016-102331

(51) Int. Cl.
*F23R 3/12* (2006.01)
*F23R 3/16* (2006.01)
(Continued)

(52) U.S. Cl.
CPC ..... *F23R 3/12* (2013.01); *F23R 3/10* (2013.01); *F23R 3/16* (2013.01); *F23R 3/42* (2013.01); *F01D 9/023* (2013.01); *F05D 2240/35* (2013.01)

(58) Field of Classification Search
CPC .... F23R 3/002; F23R 3/04; F23R 3/10; F23R 3/12; F23R 3/16; F23R 3/44; F23R 3/46;
(Continued)

(56) References Cited

U.S. PATENT DOCUMENTS 2,689,457 A * 9/1954 Kruppe ..... F23R 3/16 60/749
3,064,425 A * 11/1962 Hayes ..... F23R 3/08 60/756
(Continued)

FOREIGN PATENT DOCUMENTS

CN 101713539 5/2010
CN 104969006 10/2015
(Continued)

OTHER PUBLICATIONS

International Search Report dated Aug. 29, 2017 in corresponding International Application No. PCT/JP2017/019278.
(Continued)

*Primary Examiner* — Alain Chau
(74) *Attorney, Agent, or Firm* — Wenderoth, Lind & Ponack, L.L.P.

(57) ABSTRACT

A combustor includes: a fuel nozzle extending along an axis; a tubular combustor basket configured to cover the fuel nozzle; and a tubular transition piece configured to define a cooling air passage through which air from outside is introduced between the tubular transition piece and an outer circumferential surface of a leading end portion of the tubular combustor basket. The tubular transition piece
(Continued)

extends toward a leading end side of the tubular combustor basket.

6 Claims, 9 Drawing Sheets

(51) Int. Cl.
*F23R 3/42* (2006.01)
*F23R 3/10* (2006.01)
*F01D 9/02* (2006.01)

(58) Field of Classification Search
CPC .. F23R 3/03041–03045; F23R 3/00012; F01D 9/023; F02C 7/18
See application file for complete search history.

(56) References Cited

U.S. PATENT DOCUMENTS

| | | | | |
|---|---|---|---|---|
| 3,307,354 | A * | 3/1967 | MacAulay | F23R 3/08 60/757 |
| 3,359,724 | A * | 12/1967 | Barnwell | F23R 3/08 60/266 |
| 3,751,910 | A * | 8/1973 | Sweeney | F23R 3/08 60/757 |
| 3,826,082 | A * | 7/1974 | Smuland | F23R 3/08 60/757 |
| 4,050,241 | A * | 9/1977 | DuBell | F23M 5/085 60/757 |
| 4,773,593 | A * | 9/1988 | Auxier | F02K 1/822 239/127.3 |
| 5,239,831 | A * | 8/1993 | Kuroda | F23R 3/343 60/733 |
| 5,259,182 | A * | 11/1993 | Iwai | F23R 3/08 60/757 |
| 5,761,900 | A | 6/1998 | Presz, Jr. | |
| 6,360,528 | B1 | 3/2002 | Brausch et al. | |
| 6,732,528 | B2 * | 5/2004 | Akagi | F23R 3/002 60/746 |
| 7,032,386 | B2 * | 4/2006 | Mandai | F23R 3/04 60/757 |
| 7,421,842 | B2 * | 9/2008 | Parker | F23R 3/60 277/654 |
| 2004/0035114 | A1 | 2/2004 | Hayashi | |
| 2005/0132708 | A1 * | 6/2005 | Martling | F23R 3/60 60/752 |
| 2005/0172611 | A1 | 8/2005 | James Blodgett et al. | |
| 2010/0077761 | A1 | 4/2010 | Johnson et al. | |
| 2010/0107645 | A1 * | 5/2010 | Kollati | F23R 3/16 60/752 |
| 2013/0091847 | A1 * | 4/2013 | Chen | F23R 3/005 60/752 |
| 2014/0013762 | A1 | 1/2014 | Takiguchi et al. | |
| 2014/0331678 | A1 * | 11/2014 | Cramer | F23R 3/28 60/746 |
| 2015/0159878 | A1 | 6/2015 | Schildmacher et al. | |
| 2015/0354825 | A1 | 12/2015 | Kajimura et al. | |
| 2015/0354826 | A1 | 12/2015 | Rüdel et al. | |
| 2016/0003481 | A1 * | 1/2016 | Taniguchi | F02C 3/04 60/737 |
| 2017/0284672 | A1 * | 10/2017 | Tsunoda | F01D 9/023 |
| 2017/0299182 | A1 | 10/2017 | Miyauchi et al. | |
| 2018/0112879 | A1 * | 4/2018 | Miura | F23R 3/002 |

FOREIGN PATENT DOCUMENTS

| | | |
|---|---|---|
| DE | 807 571 | 7/1951 |
| DE | 1 015 270 | 9/1957 |
| DE | 689 28 945 | 10/1999 |
| GB | 669751 | 4/1952 |
| JP | 09-133046 | 5/1997 |
| JP | 10-61495 | 3/1998 |
| JP | 3956882 | 8/2007 |
| JP | 4293573 | 7/2009 |
| JP | 2015-230162 | 12/2015 |
| JP | 2016-65678 | 4/2016 |
| WO | 90/00929 | 2/1990 |
| WO | 2012/132898 | 10/2012 |
| WO | 2016/047397 | 3/2016 |

OTHER PUBLICATIONS

Written Opinion of the International Searching Authority dated Aug. 29, 2017 in corresponding International Application No. PCT/JP2017/019278 (with English translation).

* cited by examiner

COMBUSTOR WITH RADIALLY VARYING LEADING END PORTION OF BASKET AND GAS TURBINE

CROSS-REFERENCE TO RELATED APPLICATION

Priority is claimed from Japanese Patent Application No. 2016-102331, filed May 23, 2016, the content of which is incorporated herein by reference.

TECHNICAL FIELD

The present invention relates to a combustor and a gas turbine.

BACKGROUND ART

Generally, a combustor used for a gas turbine includes a cylindrical body on an upstream side configured to accommodate a fuel nozzle and another cylindrical body provided on a downstream side of the cylindrical body (refer to Japanese Patent No. 3956882). The cylindrical body on the downstream side has an inner diameter larger than an outer diameter of the cylindrical body on the upstream side. That is to say, in a connection portion between these two cylindrical bodies, a gap which extends in a radial direction is formed between an outer circumferential surface and an inner circumferential surface thereof.

Since a combustor basket and a transition piece have a high temperature during the operation of a combustor, it is desirable that cooling air for cooling these members be appropriately supplied. For example, a constitution in which cooling air is guided from the outside through a gap between the above-described cylindrical bodies and the cylindrical body is cooled by flowing the cooling air along an inner circumferential surface of the cylindrical body has been put to practical use.

SUMMARY OF INVENTION

Technical Problem

Here, in the combustor having the above-described constitution adopted therefor, it is desirable that cooling air flowing along the inner circumferential surface of the cylindrical body and a combustion gas flowing along an inner side in a cylinder be sufficiently mixed. If the mixing of the cooling air and the combustion gas is insufficient, the temperature of a flame at a temperature interface between the cooling air and the combustion gas decreases and the progress of a combustion reaction stagnates (quenching occurs). When such quenching occurs, the generation of carbon monoxide (CO), unburned hydrocarbons, and the like which are environmental pollutants is expedited.

An objective of the present invention is to provide a combustor and a gas turbine capable of reducing an environmental load.

Solution to Problem

According to a first aspect of the present invention, a combustor includes: a fuel nozzle extending along an axis; a tubular combustor basket configured to cover the fuel nozzle; and a tubular transition piece configured to form a cooling air passage through which air from the outside is introduced formed between the transition piece and an outer circumferential surface of a leading end portion of the combustor basket and extending toward the leading end side of the combustor basket, wherein a position in a radial direction of the leading end of the combustor basket partially varies in a circumferential direction.

With this constitution, since the position in the radial direction of the leading end of the combustor basket partially varies in the circumferential direction, when the combustion gas flows from the leading end of the combustor basket toward the downstream side, two components having different velocities in the axial direction are generated in the combustion gas flowing along the inner circumferential side of the combustor basket. Vortices extending in the axial direction are formed at the leading end of the combustor basket due to these two components joining together. These formed vortices can expedite the mixing of the air supplied through the cooling air passage and the combustion gas.

According to a second aspect of the present invention, in the combustor, the combustor basket may include an inner diameter side leading end portion in which the position in the radial direction of the leading end is located relatively inward in the radial direction and an outer diameter side leading end portion in which the position in the radial direction of the leading end is located relatively outward in the radial direction, and an inclined surface extending inward from an outer side in the radial direction from one side (a first end side of the fuel nozzle) toward the other side (a second end side of the fuel nozzle) in an axial direction may be formed between the inner diameter side leading end portion and an inner circumferential surface of the combustor basket.

With this constitution, a velocity difference in the axial direction is generated between the component passing through the inner diameter side leading end portion via the inclined surface and the component passing through the outer diameter side leading end portion in the combustion gas flowing along the inner circumferential side of the combustor basket. Vortices extending in the axial direction are formed at the leading end of the combustor basket due to these two components joining together. The formed vortices can expedite the mixing of the air supplied through the cooling air passage and the combustion gas.

According to a third aspect of the present invention, the combustor may include: a connection portion configured to connect the inner diameter side leading end portion and the outer diameter side leading end portion in the radial direction.

With this constitution, a velocity difference is generated in a flow of the combustion gas between a region on one side and a region on the other side in the circumferential direction with the connection portion sandwiched therebetween. Vortices extending in the axial direction from the downstream side of the connection portion are formed due to this velocity difference. These formed vortices can expedite the mixing of the air supplied through the cooling air passage and the combustion gas.

Also, with this constitution, it is possible to easily form the inner diameter side leading end portion and the outer diameter side leading end portion by simply performing press working or the like on the end portion of the cylindrical member.

According to a fourth aspect of the present invention, in the combustor, the outer diameter side leading end portion may be located closer to one side in the axial direction than the inner diameter side leading end portion.

With this constitution, the positions in the radial direction of the outer diameter side leading end portion and the inner diameter side leading end portion vary and the positions in the axial direction thereof also vary. Thus, it is possible to further increase a velocity difference between the combustion gas component passing through the outer diameter side leading end portion and the combustion gas component passing through the inner diameter side leading end portion. That is to say, it is possible to form stronger vortices at the leading end of the combustor basket. Thus, this can further expedite the mixing of the air supplied through the cooling air passage and the combustion gas.

According to a fifth aspect of the present invention, in the combustor, the combustor basket may further include an inclined portion in which the inclined surface is formed, which protrudes from the outer diameter side leading end portion to the other side in the axial direction, and in which a leading end on the other side in the axial direction is the inner diameter side leading end portion.

With this constitution, it is possible to easily form the inner diameter side leading end portion and the outer diameter side leading end portion in the combustor basket by simply performing press working or the like on the end portion of the cylindrical member.

According to a sixth aspect of the present invention, in the inclined portion, a width dimension in the circumferential direction toward the other side in the axial direction may gradually decrease.

With this constitution, the width dimension in the circumferential direction of the inclined portion on one side in the axial direction is larger than that of the other side and thus it is possible to prevent concentration of stress at the end portion on one side in the axial direction of the inclined portion. Thus, it is possible to improve the durability of the inclined portion. Furthermore, the width dimension of the inclined portion decreases at the leading end on the other side in the axial direction of the inclined portion. Thus, it is possible to reduce the contact area of the combustion gas with the inclined portion at the position having a higher temperature. Therefore, it is possible to improve the heat resistance of the inclined portion.

According to a seventh aspect of the present invention, in the inclined portion, a surface which faces in the circumferential direction may have a curved surface shape.

With this constitution, it is possible to smoothly connect the end portion on one side in the axial direction of the inclined portion and the outer diameter side leading end portion of the combustor basket and it is possible to prevent concentration of stress at this position.

According to an eighth aspect of the present invention, in the inclined portion, the inner diameter side leading end portion may have an acute shape.

With this constitution, since the inner diameter side leading end portion has an acute shape, it is possible to further expedite the formation of vortices extending in the axial direction on a side on the other side in the axial direction of the inner diameter side leading end portion, that is, a side on the downstream side of the inner diameter side leading end portion. To be more specific, vortices are formed along the pair of side surfaces which face in the circumferential direction in the inclined portion and the vortices on these side surfaces join together at the inner diameter side leading end portion, thereby forming a stronger vortices in the radial direction. Thus, this can further expedite the mixing of the air supplied through the cooling air passage and the combustion gas.

According to a ninth aspect of the present invention, the combustor basket may have a cooling air hole through which air is introduced from the outside formed therein.

With this constitution, when the inclined portion is formed by performing press working or the like on the combustor basket formed of, for example, the plate-like member having a hollow therein, that is, the member having an MT fin structure, the cooling air hole for cooling the inclined portion is necessarily formed in the inclined portion. Therefore, it is not necessary to separately provide a structure for actively cooling the inclined portion.

According to a tenth aspect of the present invention, a gas turbine includes: a compressor configured to generate high pressure air; the above-described combustor configured to generate a combustion gas by mixing a fuel with the high pressure air and burning the mixture; and a turbine driven using the combustion gas.

With this constitution, a combustor and a gas turbine capable of reducing an environmental load can be provided.

Advantageous Effects of Invention

According to the present invention, a combustor and a gas turbine capable of reducing an environmental load can be provided.

DESCRIPTION OF EMBODIMENTS

First Embodiment

Figure 1:
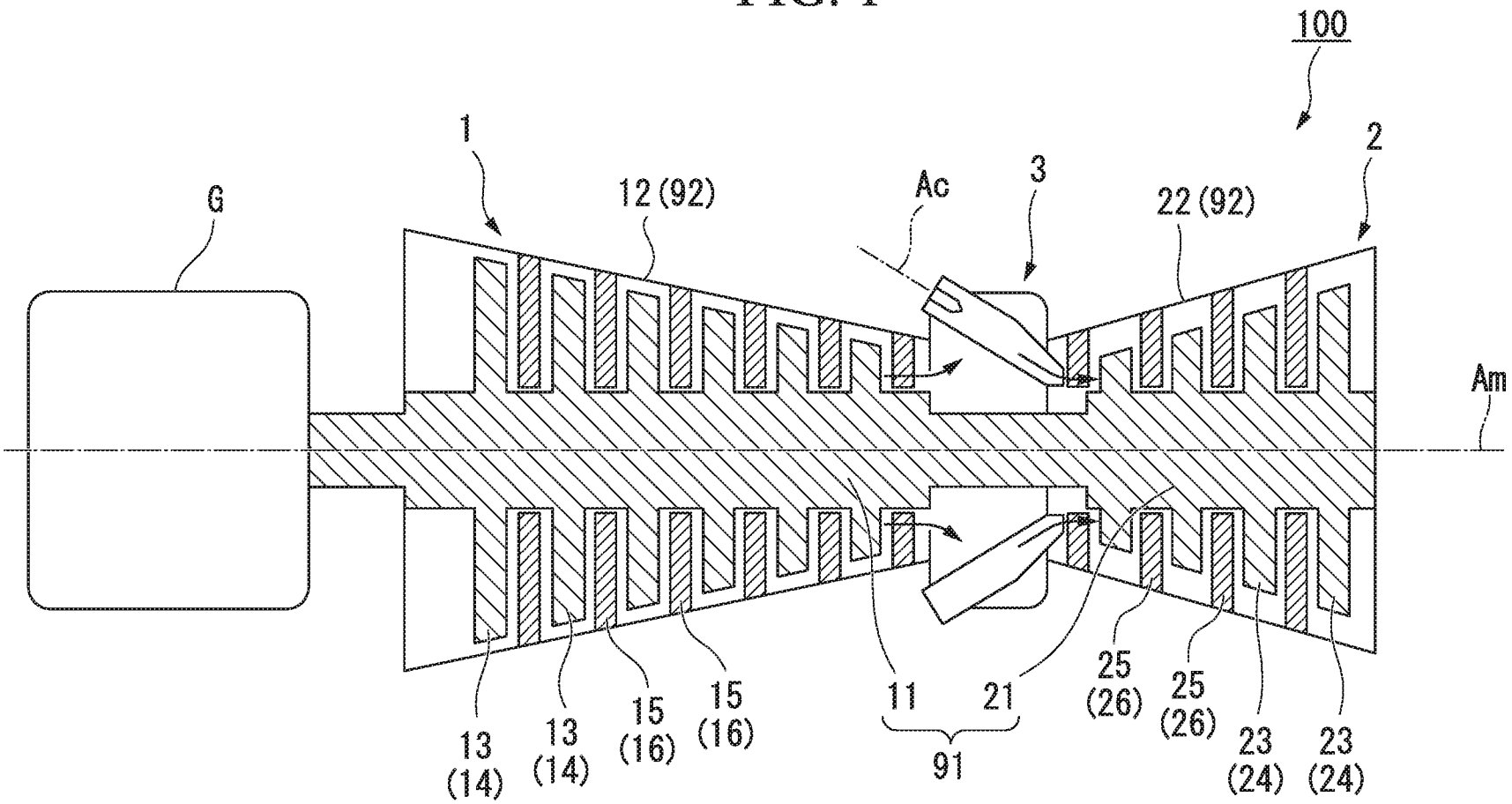
FIG. 1 is a schematic diagram showing a constitution of a gas turbine according to each embodiment of the present invention.

A first embodiment of the present invention will be described. As shown in FIG. 1, a gas turbine 100 according to the embodiment includes a compressor 1 configured to generate high pressure air, a combustor 3 configured to generate a combustion gas by mixing the high pressure air with a fuel and burning the mixture, and a turbine 2 driven by the combustion gas.

The compressor 1 includes a compressor rotor 11 extending along a central axis Am and a compressor casing 12 configured to cover the compressor rotor 11 from an outer circumferential side thereof. The compressor rotor 11 is rotatably supported about the central axis Am. A plurality of compressor blade cascades 13 arranged at intervals in the central axis Am direction are provided on the outer circumferential surface of the compressor rotor 11. Each of the compressor blade cascades 13 has a plurality of compressor blades 14 arranged at intervals in a circumferential direction around the central axis Am.

The compressor casing 12 has a tubular shape centered on the central axis Am. A plurality of compressor vane cascades 15 having a different arrangement from the compressor blade cascades 13 in the central axis Am direction are provided on an inner circumferential surface of the compressor casing 12. Each of the compressor vane cascades 15 has a plurality of compressor vanes 16 arranged at intervals in the circumferential direction around the central axis Am on the inner circumferential surface of the compressor casing 12.

The combustor 3 is provided between the compressor casing 12 and a turbine casing 22 which will be described later. Since the combustor 3 communicates with an inside of the compressor casing 12, high pressure air generated by the compressor 1 is introduced into the combustor 3. As will be described in detail later, in the combustor 3, high temperature and high pressure combustion gas is generated by mixing together and combusting high pressure air and fuel.

The turbine 2 includes a turbine rotor 21 extending along the central axis Am and the turbine casing 22 configured to cover the turbine rotor 21 from the outer circumferential side thereof. A plurality of turbine blade cascades 23 arranged at intervals in the central axis Am direction are provided on the outer circumferential surface of the turbine rotor 21. Each of the turbine blade cascades 23 has a plurality of turbine blades 24 arranged at intervals in the circumferential direction around the central axis Am.

The turbine casing 22 has a tubular shape centered on the central axis Am. A plurality of turbine vane cascades 25 having a different arrangement from the turbine blade cascades 23 in the central axis Am direction are provided on an inner circumferential surface of the turbine casing 22. Each of the turbine vane cascades 25 has a plurality of turbine vanes 26 arranged at intervals in the circumferential direction around the central axis Am on the inner circumferential surface of the turbine casing 22.

The compressor rotor 11 and the turbine rotor 21 are integrally joined on the central axis Am and form a gas turbine rotor 91. Likewise, the compressor casing 12 and the turbine casing 22 are integrally joined in the central axis Am direction and form a gas turbine casing 92. That is to say, the gas turbine rotor 91 integrally rotates about the central axis Am inside the gas turbine casing 92. For example, a generator G configured to generate electricity according to the rotation of the gas turbine rotor 91 is joined to one end of the gas turbine rotor 91.

Figure 2:
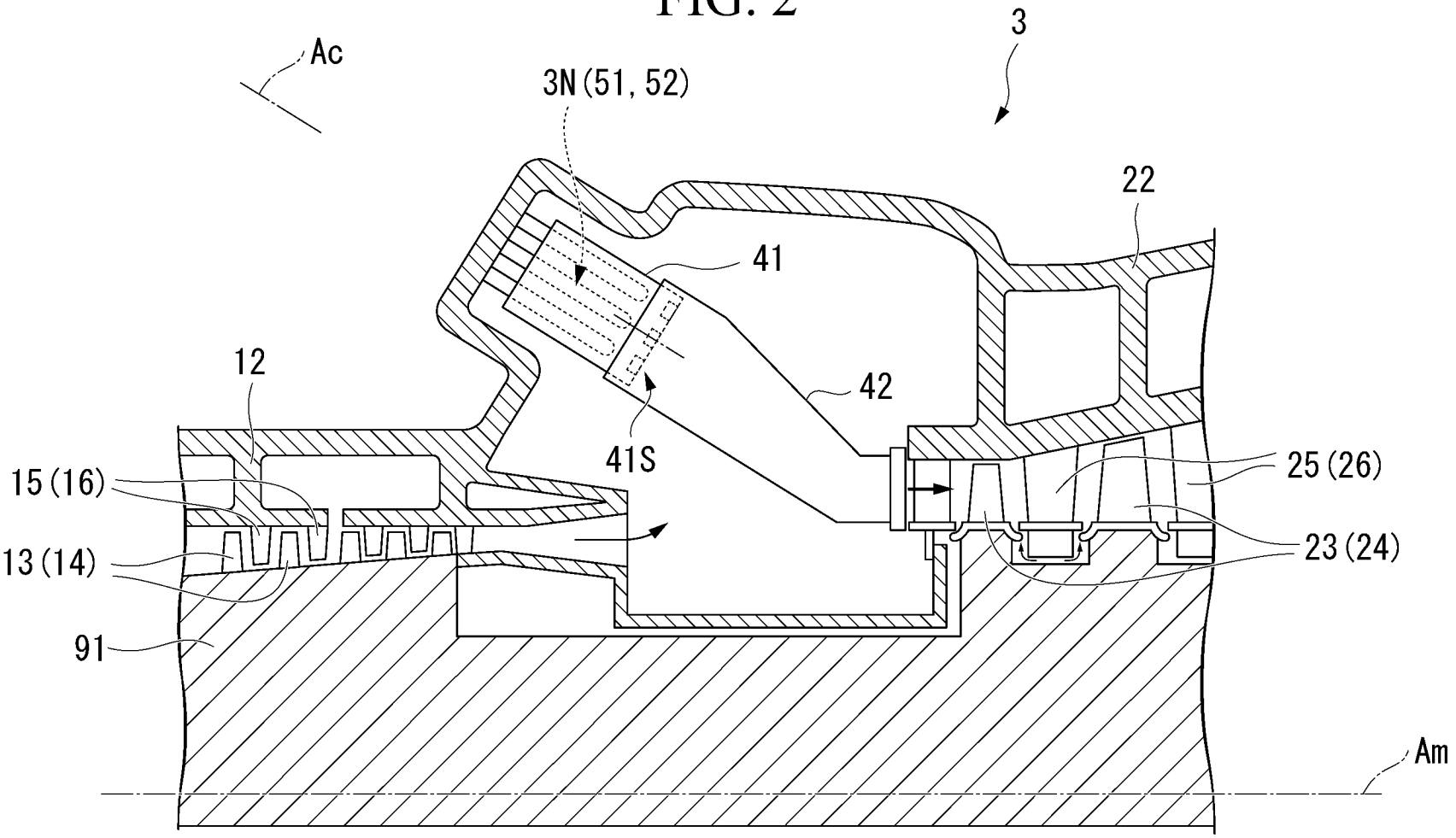
FIG. 2 is a cross-sectional view showing a constitution of a combustor according to a first embodiment of the present invention.

A detailed constitution of the combustor 3 will be described below. As shown in FIG. 1, the combustor 3 according to the embodiment has a tubular shape centered on a combustor axis Ac (axis) extending in a direction which intersects the central axis Am. In addition, to be specific, as shown in FIG. 2, the combustor 3 includes fuel nozzles 3N configured to inject a fuel, a tubular combustor basket 41 configured to accommodate the fuel nozzles 3N, and a transition piece 42 joined to a downstream side of the combustor basket 41.

A fuel supplied from a fuel supply source is injected into the combustor basket 41 through the fuel nozzles 3N. The fuel nozzles 3N have first nozzles 51 for forming a premixed combustion flame and a second nozzle 52 for igniting fuel injected through the first nozzles 51. One second nozzle 52 is provided along the combustor axis Ac. The plurality of first nozzles 51 are arranged at intervals in the circumferential direction around the combustor axis Ac.

The second nozzle 52 ignites a premixed gas injected through the first nozzles 51 by forming a diffusion combustion flame. A high temperature and high pressure combustion gas is generated in the combustor basket 41 and the transition piece 42 along with the formation of a premixed combustion flame through the first nozzles 51. In the following explanation, a direction in which this combustion gas flows is referred to as a downstream direction or toward a downstream side (the other side in an axial direction or a second end side of the fuel nozzles 3N) and a direction opposite to the downstream direction is referred to as an upstream direction or toward an upstream side (one side in the axial direction or a first end side of the fuel nozzles 3N).

Figure 3:
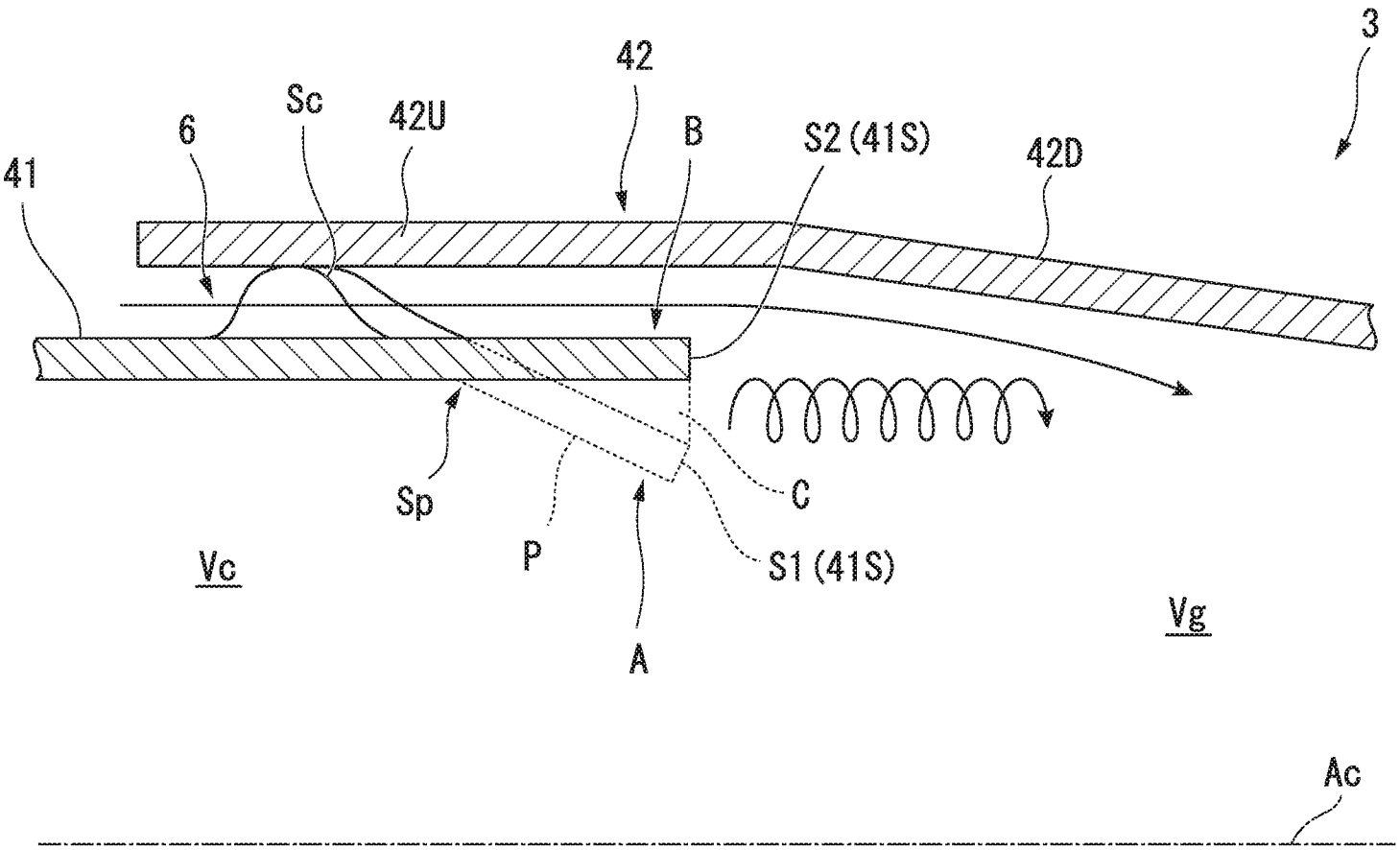
FIG. 3 is an enlarged view of a main part showing a constitution of the combustor according to the first embodiment of the present invention.

The combustor basket 41 covers the fuel nozzles 3N (first nozzles 51 and second nozzle 52) from the outer circumferential side of the combustor axis Ac. To be specific, the fuel nozzles 3N are provided in a region on the upstream side inside the combustor basket 41. As shown in FIG. 3, a region closer to the downstream side than the fuel nozzles 3N inside the combustor basket 41 is a combustion space Vc in which fuel is burned. The combustor basket 41 has a cylindrical shape centered on the combustor axis Ac. In the embodiment, a radial dimension of the combustor basket 41 is the same over the entire region in the combustor axis Ac direction.

The transition piece 42 is a tubular member connected to the downstream side of the combustor basket 41. To be more specific, the transition piece 42 includes an upstream portion of the transition piece 42U having a constant radial direction dimension and a downstream portion of the transition piece 42D which is integrally connected to the upstream portion of the transition piece 42U and whose diameter gradually decreases toward the downstream side. The upstream portion of the transition piece 42U has an inner diameter dimension larger than that of the combustor basket 41.

A space on an inner circumferential side of the transition piece 42 is a combustion gas flow path Vg for guiding the combustion gas to the subsequent turbine 2. A partial region including a downstream side end portion 41D of the combustor basket 41 is inserted into the inner circumferential side of the transition piece 42 (the upstream portion 42U). In a state in which the combustor basket 41 is inserted into the transition piece 42, a gap extending in a radial direction of the combustor axis Ac is formed between an outer circumferential surface of the combustor basket 41 and an inner circumferential surface of the transition piece 42. This gap is a cooling air passage 6 for guiding air flowing through an outer side of the combustor 3 (a space in the gas turbine casing 92). A spring clip Sc for connecting the combustor basket 41 and the transition piece 42 so that the combustor basket 41 and the transition piece 42 cannot be detached from each other is provided in the cooling air passage 6.

Figure 4:
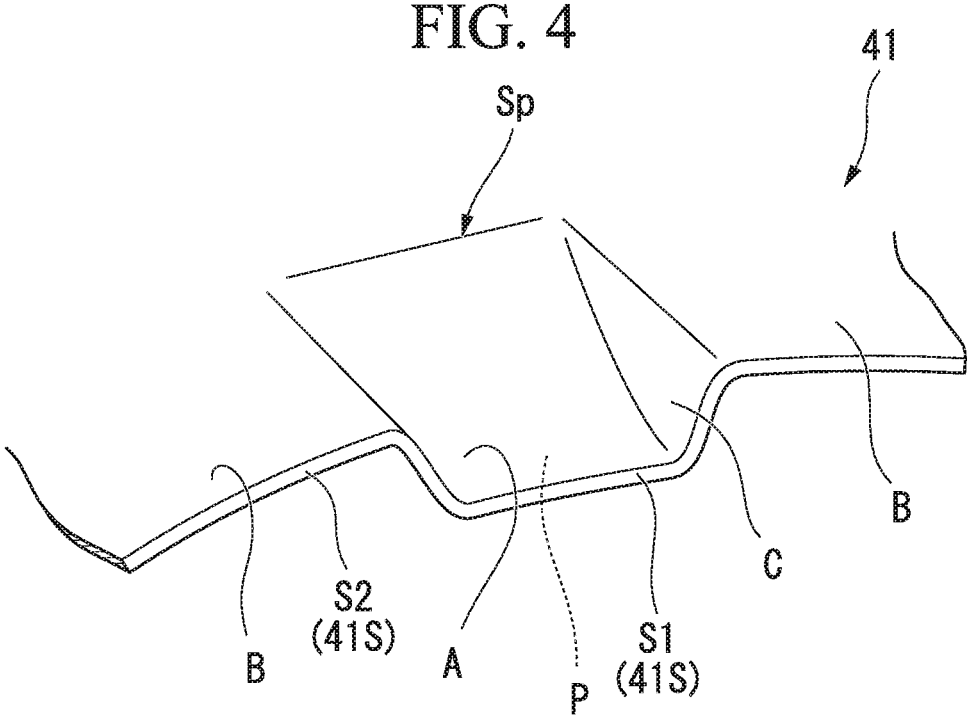
FIG. 4 is a perspective view showing a constitution of a combustor basket according to the first embodiment of the present invention.

Also, as shown in FIG. 3 or 4, a leading end 41S of the combustor basket 41 (an end edge on the downstream side) has a concave and convex shape when viewed from the combustor axis Ac direction. That is to say, a radial position of the leading end 41S partially varies in the circumferential direction. To be more specific, the combustor basket 41 has an inclined portion A extending from a base end portion Sp toward the downstream side and extending portions B adjacent to the inclined portion A in the circumferential direction formed therein. Here, the base end portion Sp indicates a position closer to the upstream side than the leading end 41S and closer to the downstream side than the spring clip Sc.

The inclined portion A extends in the radial direction from the outside to the inside from the base end portion Sp toward the downstream side. On the other hand, the extending portions B extend from the base end portion Sp to the downstream side along the combustor axis Ac. That is to say, an outer circumferential surface and an inner circumferential surface of the extending portions B are continuous with the outer circumferential surface and an inner circumferential surface of the combustor basket 41.

The inclined portion A and the extending portions B are alternately arranged in the circumferential direction. That is to say, one inclined portion A is surrounded by the pair of extending portions B adjacent to both sides thereof in the circumferential direction. The inclined portion A has a planar shape in which the inclined portion A intersects the radial direction of the combustor axis Ac when viewed from the downstream side. On the other hand, the extending portions B has the same circular arc shape as the outer circumferential surface of the combustor basket 41.

An end edge on the downstream side of the inclined portion A is an inner diameter side leading end portion S1 which is located relatively inward in the radial direction. An end edge on the downstream side of the extending portions B is an outer diameter side leading end portion S2 which is located further outward in the radial direction than the inner diameter side leading end portion S1. Thus, an opening diameter of the combustor basket 41 in a region in which the inner diameter side leading end portion S1 is formed is partially smaller that of other regions (a region in which the outer diameter side leading end portion S2 is formed).

A surface on the inner circumferential side of the inclined portion A is an inclined surface P. The inclined surface P extends in a direction in which the inclined surface P intersects the combustor axis Ac between the inner diameter side leading end portion S1 and the inner circumferential surface of the combustor basket 41 (base end portion Sp). The inclined surface P extends in the radial direction from the outside to the inside from the upstream side toward the downstream side.

Also, in the embodiment, the inclined portion A and the extending portions B are connected to each other through a connection portion C. To be more specific, the connection portion C is connected to end portions on both sides in the circumferential direction of the inclined portion A and an end portion in the circumferential direction of the extending portions B in the radial direction. The connection portion C has a substantially triangular shape when viewed from the circumferential direction around the combustor axis Ac. The connection portion C is integrally formed with the inclined portion A and the extending portions B. In order to obtain such a constitution, for example, a method of performing press working or the like on an end portion of a cylindrical member is conceivable.

An operation of the gas turbine 100 and the combustor 3 constituted as described above will be described. When operating the gas turbine 100, first, the compressor rotor 11 (gas turbine rotor 91) is rotatably driven through an external driving source. External air is compressed sequentially by the compressor 1 along with the rotation of the compressor rotor 11 and thus high pressure air is generated. This high pressure air is supplied into the combustor 3 through a space in the compressor casing 12. A fuel supplied through the fuel nozzles 3N is mixed with the high pressure air in the combustor 3, is burned, and a high temperature and high pressure combustion gas is generated. The combustion gas is supplied to the turbine 2 through a space inside the turbine casing 22. The combustion gas sequentially collides with the turbine blades 24 and the turbine vanes 26 in the turbine 2 so that a rotational driving force is exerted on the turbine rotor 21 (gas turbine rotor 91). This rotational energy is used for driving the generator G joined to an axial end.

Next, an operation of the combustor 3 will be described in detail. High pressure air generated in the compressor 1 is supplied from one side of the combustor axis Ac (upstream side) into the combustor basket 41. The high pressure air introduced into the combustor basket 41 is mixed with a fuel injected through the fuel nozzles 3N to form a premixed gas. A premixed combustion flame is formed by igniting this premixed gas using an igniter (not shown). This premixed combustion flame extends from the upstream side toward the downstream side in the combustor basket 41 and generates a high temperature and high pressure combustion gas. The combustion gas flows from the upstream side toward the downstream side in the transition piece 42, is introduced into the turbine casing 22, and drives the turbine 2.

Here, as described above, the cooling air passage 6 is formed between the outer circumferential surface of the combustor basket 41 and the inner circumferential surface of the transition piece 42. High pressure air flowing along an outer side of the combustor 3 flows into the combustor 3 through the cooling air passage 6. Cooling air flows from the upstream side to the downstream side along the inner circumferential surface of the transition piece 42. On the other hand, the combustion gas generated in the combustor basket 41 also flows in the vicinity of the inner circumferential surface of the transition piece 42. In order to secure the efficiency of the combustor 3, it is desirable that the cooling air and the combustion gas be sufficiently mixed. If the cooling air and the combustion gas are insufficiently mixed, a temperature of a flame at a temperature interface between the cooling air and the combustion gas decreases and the progress of a combustion reaction stagnates (quenching occurs). When the quenching occurs, there is a concern of expedition of the generation of carbon monoxide (CO), unburned hydrocarbons, and the like and an increase in an environmental impact of the combustor 3.

Thus, in the combustor 3 according to the embodiment, the leading end 41S of the combustor basket 41 has the concave and convex shape formed thereon. To be specific, the leading end 41S has the inclined portion A, the extending portions B, and the connection portion C formed thereon. That is to say, since the radial position of the leading end 41S of the combustor basket 41 partially varies in the circumferential direction, when the combustion gas flows from the leading end 41S toward the downstream side, two components having different velocities in the combustor axis Ac direction are generated in the combustion gas flowing along the inner circumferential side of the combustor basket 41.

To be more specific, a velocity difference in the combustor axis Ac direction is generated between a component passing through the inner diameter side leading end portion S1 via the inclined surface P (a component having a relatively high flow velocity) and a component passing through the outer diameter side leading end portion S2 (a component having a relatively low flow velocity) in the combustion gas flowing along the inner circumferential side of the combustor basket 41. The two components join together so that vortices extending in the combustor axis Ac direction are formed on the downstream side of the leading end 41S.

By forming these vortices, the mixing of air supplied through the cooling air passage 6 and a combustion gas can be expedited. Thus, it is possible to minimize the quenching of a flame caused by insufficient mixing between the cooling air and the combustion gas and the generation of CO or unburned hydrocarbons. Therefore, it is possible to reduce the environmental impact of the combustor 3 and the gas turbine 100.

Also, with this constitution, it is possible to easily form the combustor basket 41 having the inclined portion A, the extending portions B, and the connection portion C by simply performing press working or the like on an end portion of a member formed in a tubular shape in advance.

Second Embodiment

Figure 5:
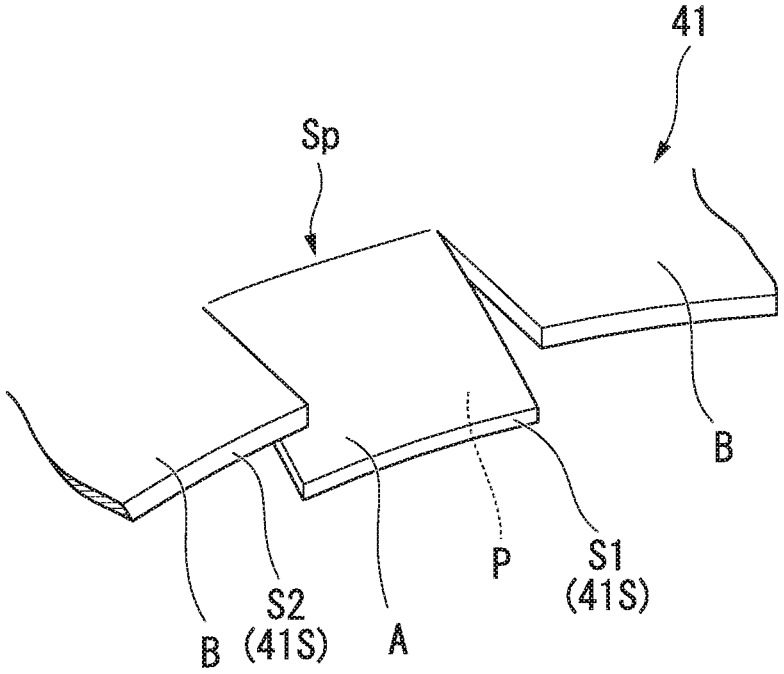
FIG. 5 is a perspective view showing a constitution of a combustor basket according to the second embodiment of the present invention.

A second embodiment of the present invention will be described below with reference to FIG. 5. Constituent elements that are the same as those of the first embodiment will be denoted by the same reference numerals and a detailed description thereof will be omitted. As shown in this drawing, in the embodiment, an inclined portion A and an extending portions B are formed at a leading end 41S of an combustor basket 41 as in the first embodiment, whereas a connection portion C is not formed between the inclined portion A and the extending portions B. That is to say, a gap is formed between the inclined portion A and the extending portions B. In order to obtain such a constitution, a method of cutting out an end portion of a member formed in a tubular shape in advance is conceivable.

Also in this constitution, since a radial position of a leading end 41S of the combustor basket 41 partially varies in the circumferential direction, when the combustion gas flows from the leading end 41S toward the downstream side, two components having different velocities in a combustor axis Ac direction are generated in a combustion gas flowing along an inner circumferential side of the combustor basket 41.

To be more specific, a velocity difference in the combustor axis Ac direction is generated between a component passing through an inner diameter side leading end portion S1 via an inclined surface P (a component having a relatively high flow velocity) and a component passing through an outer diameter side leading end portion S2 (a component having a relatively low flow velocity) in the combustion gas flowing along the inner circumferential side of the combustor basket 41. The two components join together so that vortices extending in the combustor axis Ac direction are formed on the downstream side of the leading end 41S.

By forming these vortices, the mixing of air supplied through the cooling air passage 6 and a combustion gas can be expedited. Thus, it is possible to minimize the quenching of a flame caused by the insufficient mixing between the cooling air and the combustion gas and the generation of CO or unburned hydrocarbons. Therefore, it is possible to reduce the environmental impact of the combustor 3 and the gas turbine 100.

Also, with this constitution, it is possible to easily form the combustor basket 41 having the inclined portion A and the extending portions B simply by cutting out an end portion of a member formed in a tubular shape in advance.

Third Embodiment

Figure 6:
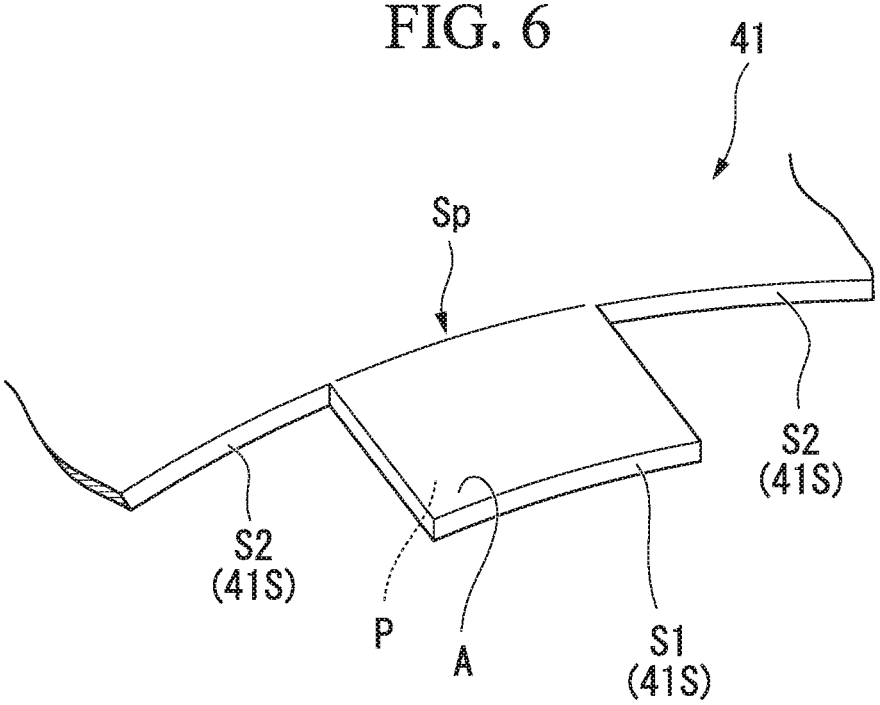
FIG. 6 is a perspective view showing a constitution of a combustor basket according to a third embodiment of the present invention.

A third embodiment of the present invention will be described below with reference to FIG. 6. Constituent elements that are the same as those of the above-described first embodiment and second embodiment will be denoted by the same reference numerals and a detailed description thereof will be omitted. As shown in this drawing, in an combustor basket 41 associated with the embodiment, the above-described extending portions B is not formed. That is to say, in the combustor basket 41, only inclined portions A arranged at intervals in the circumferential direction are formed at a base end portion Sp. Each of the inclined portions A protrude in a rectangular shape from the base end portion Sp toward the downstream side.

Here, as will be described later, in the third embodiment, even when the radial position of a leading end 41S of the combustor basket 41 does not partially vary in the circumferential direction, when the combustion gas flows from the base end portion Sp toward the downstream side, two components having different flow velocities in the combustor axis Ac direction are generated in the combustion gas flowing along the inner circumferential side of the combustor basket 41 in accordance with the presence or absence of the protruding inclined portions A.

The end edges on the downstream side of each of the inclined portions A is an inner diameter side leading end portion S1. On the other hand, an end edge extending in the circumferential direction between a pair of inclined portions A adjacent to each other is an outer diameter side leading end portion S2. That is to say, in the inner diameter side leading end portion S1 and the outer diameter side leading end portion S2, positions thereof in a combustor axis Ac direction are different from each other. To be more specific, in the embodiment, the inner diameter side leading end portion S1 is located closer to the downstream side in the combustor axis Ac direction than the outer diameter side leading end portion S2.

Also in this constitution, since the radial position of the leading end 41S of the combustor basket 41 partially varies in the circumferential direction, when the combustion gas flows from the leading end 41S toward the downstream side, two components having different velocities in a combustor axis Ac direction are generated in the combustion gas flowing along the inner circumferential side of the combustor basket 41.

To be more specific, a velocity difference in the combustor axis Ac direction is generated between a component passing through the inner diameter side leading end portion S1 via the inclined surface P (a component having a relatively high flow velocity) and a component passing through the outer diameter side leading end portion S2 (a component having a relatively low flow velocity) in the combustion gas flowing along an inner circumferential side of the combustor basket 41. The two components join together so that vortices extending in the combustor axis Ac direction are formed on the downstream side of the leading end 41S.

By forming these vortices, the mixing of air supplied through the cooling air passage 6 and a combustion gas can be expedited. Thus, it is possible to minimize the quenching of a flame caused by the insufficient mixing between the cooling air and the combustion gas and the generation of CO or unburned hydrocarbons. Therefore, it is possible to reduce the environmental impact of the combustor 3 and the gas turbine 100.

Also, with this constitution, positions of the outer diameter side leading end portion and the inner diameter side leading end portion in the radial direction vary and positions thereof in the axial direction also vary. Thus, it is possible to further increase a velocity difference between a combustion gas component passing through the outer diameter side leading end portion and a combustion gas component passing through the inner diameter side leading end portion. That is to say, a stronger vortex can be formed at a lead end of the combustor basket. Thus, the mixing of air supplied through the cooling air passage and a combustion gas can be further expedited.

Here, even when positions in the radial direction of the outer diameter side leading end portion and the inner diameter side leading end portion do not differ, when positions in the axial direction of the outer diameter side leading end portion and the inner diameter side leading end portion differ, a velocity difference is generated between the combustion gas component passing through the outer diameter side leading end portion and the combustion gas component passing through the inner diameter side leading end portion. That is to say, a vortex can be formed at the leading end of the combustor basket. Thus, the mixing of air supplied through the cooling air passage and a combustion gas can be expedited.

First Modified Example of Third Embodiment

Figure 7:
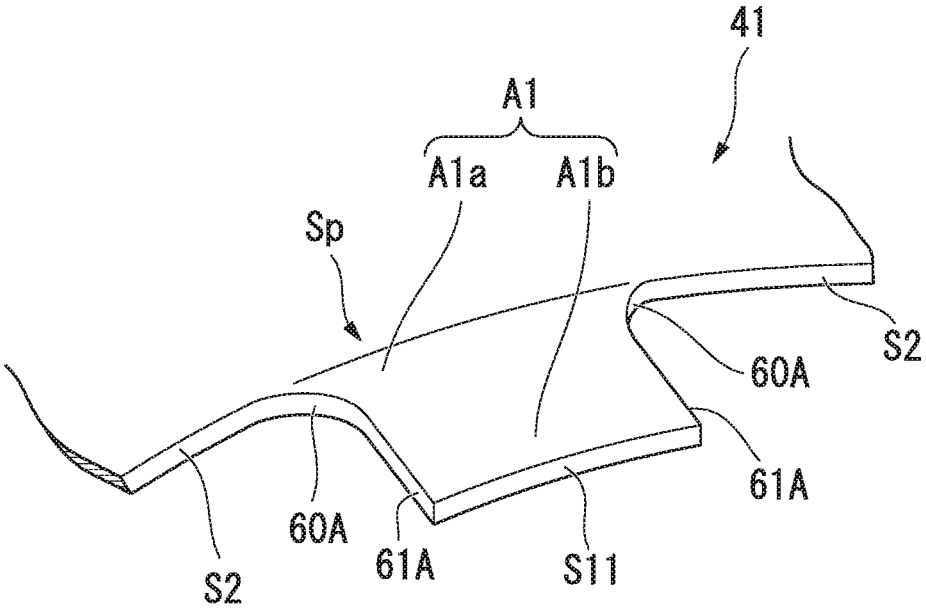
FIG. 7 is a perspective view showing a constitution of a combustor basket according to a first modified example of the third embodiment of the present invention.

Here, in this embodiment, as shown in FIG. 7, an inclined portion A1 may include a base portion A1*a* disposed on the upstream side and an end portion A1*b* which is integrally formed with the base portion A1*a* and disposed on a downstream side of the base portion A1*a*.

The base portion A1*a* is continuous with an outer diameter side leading end portion S2, extends toward the downstream side, and has a width dimension in the circumferential direction toward the downstream side which gradually decreases. Thus, a pair of side surfaces 60A which are located on both end portions in the circumferential direction on the base portion A1*a* and face in the circumferential direction have a curved surface shape curved in a concave shape so that the pair of side surfaces 60A become closer to each other in the circumferential direction. Moreover, the pair of side surfaces 60A are smoothly connected to the outer diameter side leading end portion S2 without a corner.

The end portion A1*b* has a rectangular shape. That is to say, the end portion A1*b* has the same shape as the inclined portion A shown in FIG. 6. A pair of side surfaces 61A which are located on both sides in the circumferential direction on the end portion A1*b* and face in the circumferential direction have a planar shape and are continuous with a downstream side on the side surfaces 60A. An end edge on the downstream side of the end portion A1*b* is an inner diameter side leading end portion S11 having a planar shape.

In this modified example, a corner is not formed at a base end portion Sp of the inclined portion A1 by the side surfaces 60A of the base portion Ala, a width dimension in the circumferential direction of the inclined portion A1 increases on the base end portion Sp side, and thus it is possible to prevent concentration of stress at the base end portion Sp. Thus, the durability of the combustor basket 41 can be improved.

Second Modified Example of Third Embodiment

Figure 8:
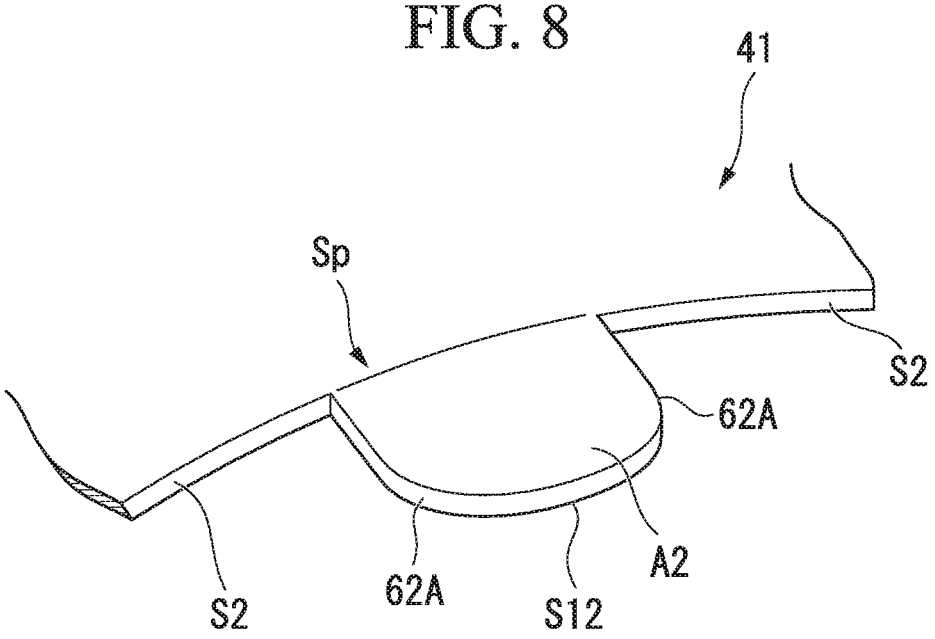
FIG. 8 is a perspective view showing a constitution of a combustor basket according to a second modified example of the third embodiment of the present invention.

Also, in this embodiment, as shown in FIG. 8, an inclined portion A2 may have a substantially semicircular shape. That is to say, a pair of side surfaces 62A which face in the circumferential direction have curved surface shapes in which the side surfaces 62A are curved in a concave shape away from each other in the circumferential direction and are smoothly connected at an inner diameter side leading end portion S12. Thus, a width dimension in the circumferential direction of the inclined portion A2 decreases gradually from a base end portion Sp to an inner diameter side leading end portion S12 toward the downstream side.

In this modified example, in a portion on the downstream side of the inclined portion A2 having a higher temperature, the width dimension in the circumferential direction of the inclined portion A2 can be decreased to be smaller than that of a portion on the upstream side. Thus, since it is possible to reduce a contact area between a combustion gas and the inclined portion A2 at a position on the upstream side having a higher temperature and a corner is not formed in the inner diameter side leading end portion S12, it is possible to improve the heat resistance of the inclined portion A2.

Third Modified Example of Third Embodiment

Figure 9:
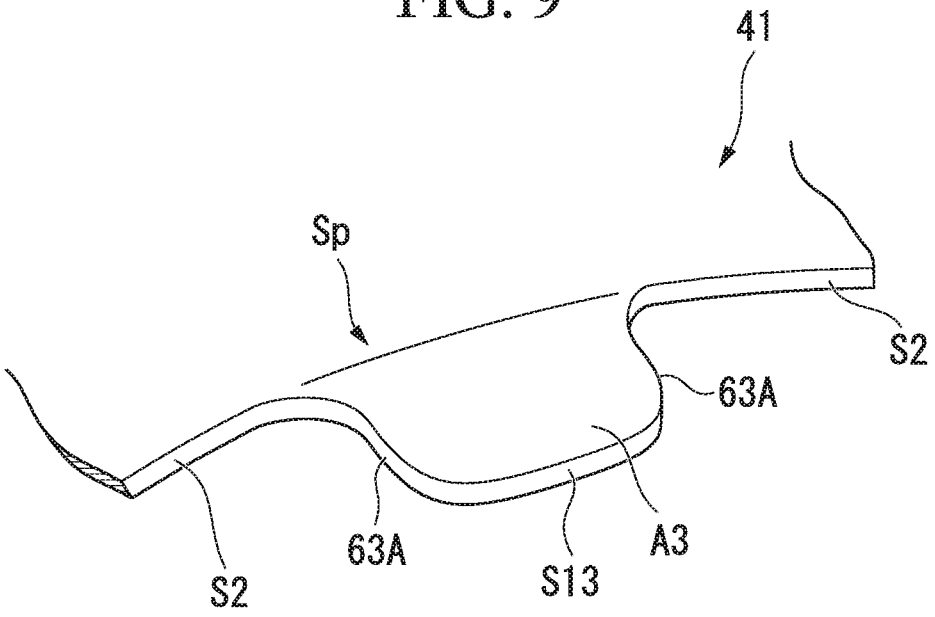
FIG. 9 is a perspective view showing a constitution of a combustor basket according to a third modified example of the third embodiment of the present invention.

In this embodiment, as shown in FIG. 9, a pair of side surfaces 63A which face in the circumferential direction of an inclined portion A3 may have curved surface shapes in which the pair of side surfaces 63A are smoothly continuous and are smoothly connected at an inner diameter side leading end portion S13. Furthermore, each of the side surfaces 63A is smoothly connected to an outer diameter side leading end portion S2 without a corner. To be more specific, the pair of side surfaces 63A have curved surface shapes which are curved in a concave shape so that the pair of side surfaces 63A become closer to each other in the circumferential direction from a connection portion with the outer diameter side leading end portion S2 toward the downstream side and then are curved in a convex shape so that the pair of side surfaces 63A become further away from each other in the circumferential direction.

In this modified example, a corner is not formed at a base end portion Sp of the inclined portion A3 by the side surfaces 63A, a width dimension in the circumferential direction of the inclined portion A3 increases, and thus it is possible to prevent concentration of stress at the base end portion Sp. Thus, it is possible to improve the durability. In addition, in a portion on the downstream side of the inclined portion A3 having a higher temperature, a width dimension in the circumferential direction of the inclined portion A3 can be decreased to be smaller than that of a portion on the upstream side and a corner is not formed in the inner diameter side leading end portion S13. Thus, it is possible to improve the heat resistance of the inclined portion A3.

Fourth Modified Example of Third Embodiment

Figure 10:
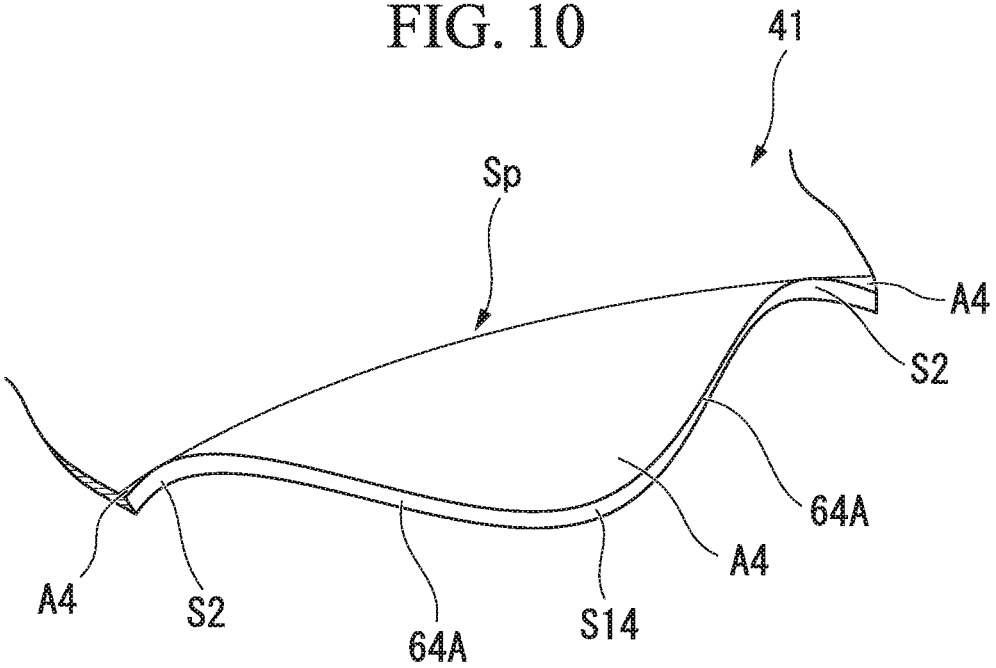
FIG. 10 is a perspective view showing a constitution of a combustor basket according to a fourth modified example of the third embodiment of the present invention.

In this embodiment, as shown in FIG. 10, a plurality of inclined portions A4 may be provided at equal intervals to be continuous in the circumferential direction.

Also, a pair of side surfaces 64A which face in the circumferential direction of each of the inclined portions A4 may have a curved surface shape in which the pair of side surfaces 64A are smoothly continuous and be smoothly connected to each other at an inner diameter side leading end portion S14 without a corner. Furthermore, each of the side surfaces 64A is smoothly connected to the outer diameter side leading end portion S2 without a corner. To be more specific, the pair of side surfaces 64A have curved surface shapes which are curved in a concave shape so that the pair of side surfaces 64A become closer to each other in the circumferential direction from a connection portion with the outer diameter side leading end portion S2 toward the downstream side and then are curved in a convex shape so that the pair of side surfaces 64A become further away from each other in the circumferential direction.

In addition, the side surfaces 64A in the inclined portion A4 which are adjacent to each other in the circumferential direction are smoothly connected to each other without a corner. A width dimension in the circumferential direction of the inclined portion A4 decreases gradually toward the downstream side from a base end portion Sp to the inner diameter side leading end portion S14. As a result, all of the side surfaces 64A are integrally formed in a sine curve shape when the inclined portion A4 is viewed from the radial direction.

In this modified example, a corner is not formed at the base end portion Sp in the inclined portion A4 by the side surfaces 64A, a width dimension in the circumferential direction increases, and thus it is possible to prevent concentration of stress at the base end portion Sp. Thus, it is possible to improve the durability. In addition, in a portion on the downstream side of the inclined portion A4 having a higher temperature, a width dimension in the circumferential direction of the inclined portion A4 can be decreased to be smaller than that of a portion on the upstream side. Thus, since it is possible to reduce a contact area with the combustion gas and a corner is not formed in the inner diameter side leading end portion S14, it is possible to improve the heat resistance of the inclined portion A4.

Fifth Modified Example of Third Embodiment

Figure 11:
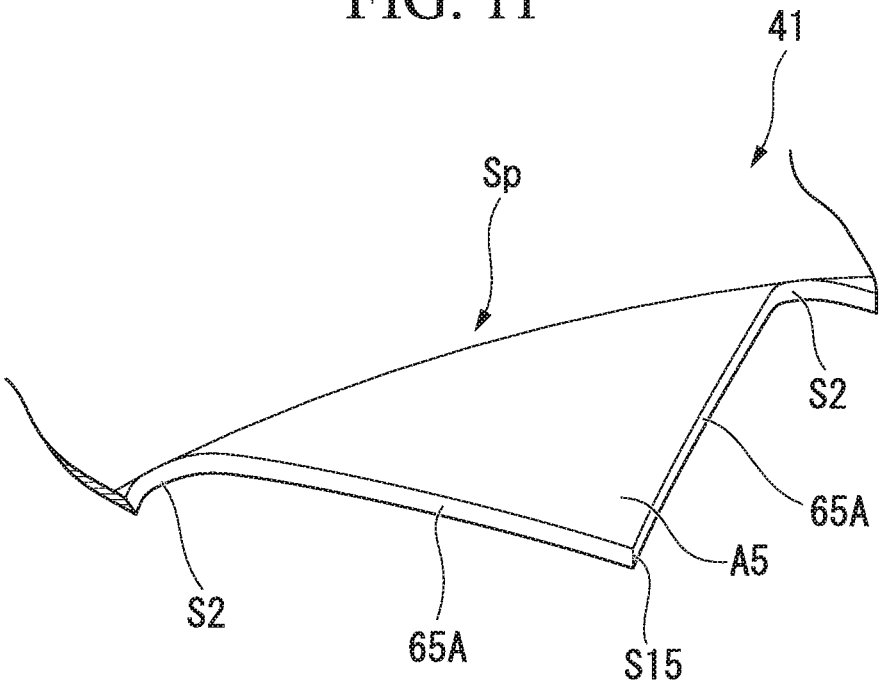
FIG. 11 is a perspective view showing a constitution of a combustor basket according to a fifth modified example of the third embodiment of the present invention.

In this embodiment, as shown in FIG. 11, a plurality of inclined portions A5 may be provided at equal intervals to be continuous in the circumferential direction.

A pair of side surfaces 65A are connected to each other so that the pair of side surfaces 65A which face in the circumferential direction of each of the inclined portions A5 have a planar shape and an inner diameter side leading end portion S15 has an acute shape with a corner. Furthermore, each of the side surfaces 65A may be connected to an outer diameter side leading end portion S2 without or with a corner.

In addition, the side surfaces 65A in the inclined portion A5 which are adjacent to each other in the circumferential direction may be connected to each other without or with a corner. A width dimension in the circumferential direction of the inclined portion A5 decreases gradually from the base end portion Sp to the inner diameter side leading end portion S15 toward the downstream side. That is to say, each of the inclined portions A5 has a triangular shape when viewed from the radial direction and all of the side surfaces 65A are integrally formed in a serrated shape when the inclined portion A5 is viewed from the radial direction.

In this modified example, the inner diameter side leading end portion S15 has an acute shape. Thus, it is possible to further expedite the formation of vortices extending in the combustor axis Ac direction on the downstream side of the inner diameter side leading end portion S15. To be more specific, a flow directed from a radially inner side toward a radially outer side is generated due to a pressure difference using each of the side surfaces 65A as a boundary. Moreover, a vortex directed outward in the radial direction is formed in the vicinity of the side surface 65A and a vortex directed inward in the radial direction is formed at a position which is a vortex diameter away from the side surface 65A outward in the radial direction. Moreover, vortices flowing along the side surfaces 65A include counterclockwise vortices along one of the side surfaces 65A and clockwise vortices along the other of the side surfaces 65A when viewed from the downstream side. When the vortices along the pair of side surfaces 65A join together at the inner diameter side leading end portion S15, a flow component in a radially outward direction becomes large. Thus, a strong vortex in the radial direction is formed. Therefore, it is possible to expedite the mixing of air supplied through a cooling air passage 6 (refer to FIG. 3) and a combustion gas and it is possible to further reduce the environmental impact of the combustor 3 and the gas turbine 100.

Sixth Modified Example of Third Embodiment

Figure 12:
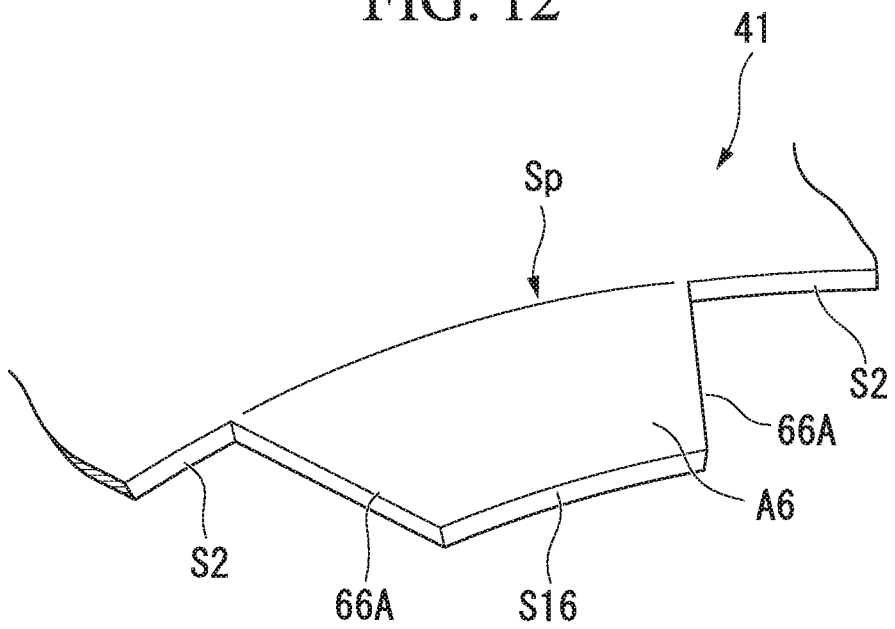
FIG. 12 is a perspective view showing a constitution of a combustor basket according to a sixth modified example of the third embodiment of the present invention.

In this embodiment, as shown in FIG. 12, an inclined portion A6 may have a trapezoidal shape. That is to say, a pair of side surfaces 66A which face in the circumferential direction have a planar shape and are connected toward the downstream side to both ends which are adjacent to each other of an inner diameter side leading end portion S16 having a planar shape and extending in the circumferential direction. As a result, a width dimension in the circumferential direction of the inclined portion A6 decreases gradually from a base end portion Sp to the inner diameter side leading end portion S16 toward the downstream side.

In this modified example, an angle formed by the side surfaces 66A at the base end portion Sp of the inclined portion A6, that is, an angle of a connection portion between the side surfaces 66A and the outer diameter side leading end portion S2, is an obtuse angle and it is possible to reduce concentration of stress at the base end portion Sp. Thus, it is possible to improve the durability of the combustor basket 41.

Here, in the third embodiment including the first modified example to the sixth modified example, when positions in the axial direction of the outer diameter side leading end portion and the inner diameter side leading end portion differ, as described above, positions in the radial direction of the outer diameter side leading end portion and the inner diameter side leading end portion do not vary in some cases. That is to say, the inclined portions A, A1, A2, A3, A4, A5, and A6 may not inclined from a wall surface of the combustor basket 41.

To be specific, a combustor includes a fuel nozzle which extends along an axis, a tubular combustor basket which covers the fuel nozzle, and a tubular transition piece which has a cooling air passage through which air from the outside is introduced formed between the transition piece and an outer circumferential surface of a leading end portion of the combustor basket and extends toward the leading end side of the combustor basket. In addition, the combustor basket has a protruding portion which protrudes from the outer diameter side leading end portion toward the downstream side which is the other side in the axial direction and has the same shape as the inclined portion A, A1, A2, A3, A4, A5, or A6 in which the leading end of the other side in the axial direction is the inner diameter side leading end portion.

With this constitution, a velocity difference is generated between a combustion gas component passing through the outer diameter side leading end portion and a combustion gas component passing through the inner diameter side leading end portion and vortices can be formed at the leading end of the combustor basket. Thus, the mixing of air supplied through the cooling air passage and a combustion gas can be expedited.

When the positions in the radial direction of the outer diameter side leading end portion and the inner diameter side leading end portion do not differ, it is possible to manufacture the combustor basket simply by cutting processing such as laser cutting without performing press working, thereby facilitating the production.

Fourth Embodiment

Figure 13:
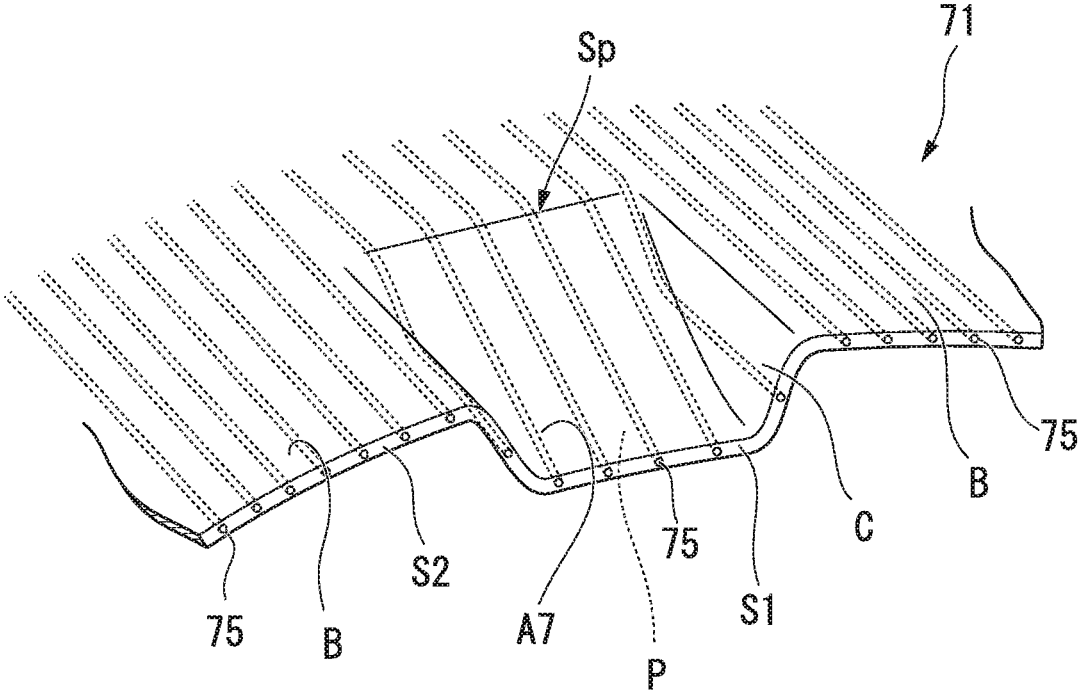
FIG. 13 is a perspective view showing a constitution of a combustor basket according to a fourth embodiment of the present invention.

A fourth embodiment of the present invention will be described below with reference to FIG. 13. Constituent elements that are the same as those of the above-described first embodiment to third embodiment will be denoted by the same reference numerals and a detailed description thereof will be omitted. As shown in this drawing, an combustor basket 71 associated with this embodiment has the same constitution as the first embodiment except that the combustor basket 71 further has cooling air holes 75 formed therein. That is to say, the combustor basket 71 is formed of a plate-like member having a flow path serving as a hollow called an MT fin.

The cooling air holes 75 open at an inner diameter side leading end portion S1 and an outer diameter side leading end portion S2 and extend along a combustor axis Ac. The plurality of cooling air holes 75 are provided at intervals in the circumferential direction. The entire combustor basket 71 is cooled by introducing cooling air from the outside into each of the cooling air holes 75.

With this constitution, when an inclined portion A7 is formed by performing press working or the like on the combustor basket 71 having an MT fin structure, the cooling air holes 75 for cooling the inclined portion A7 are necessarily formed in the inclined portion A7. Therefore, there is an advantage in that it is not necessary to separately provide a structure for actively cooling the inclined portion A7.

Modified Example of Fourth Embodiment

Figure 14:
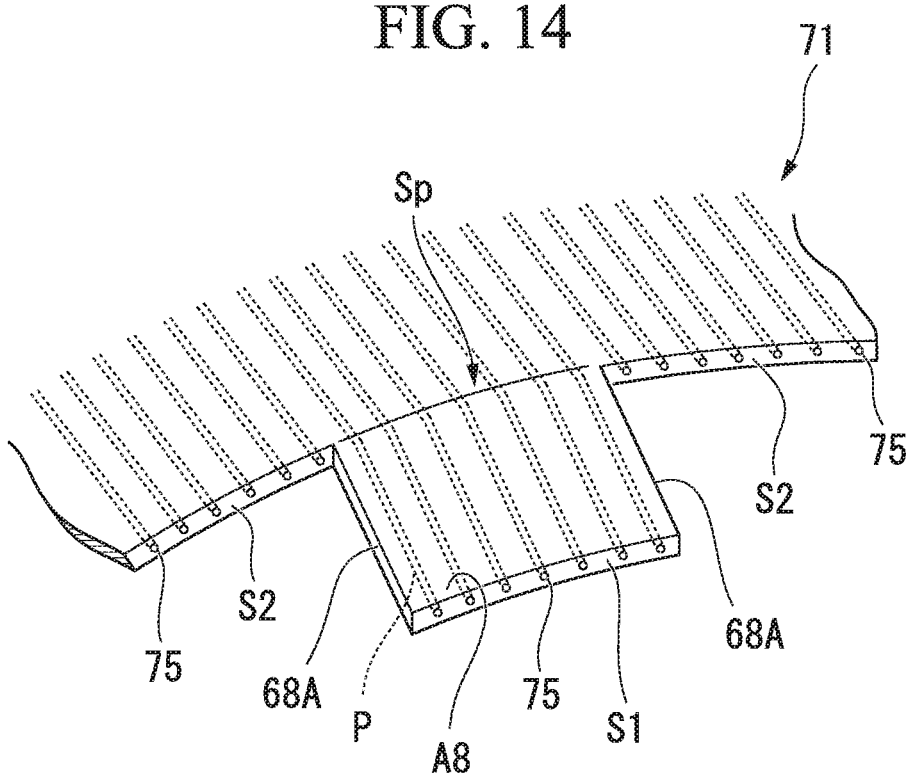
FIG. 14 is a perspective view showing a constitution of a combustor basket according to a first modified example of the fourth embodiment of the present invention.
Figure 15:
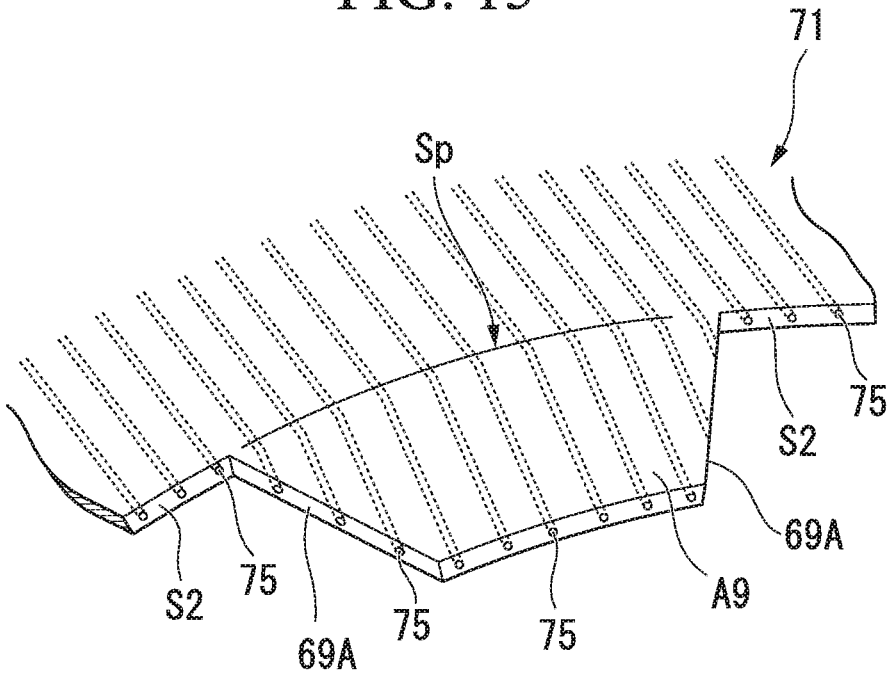
FIG. 15 is a perspective view showing a constitution of a combustor basket according to a second modified example of the fourth embodiment of the present invention.

Here, in this embodiment, as shown in FIG. 14, cooling air holes 75 may be formed in an inclined portion A8 having the same shape as the inclined portion A in the third embodiment. Furthermore, as shown in FIG. 15, the cooling air holes 75 may be formed in an inclined portion A9 having the same trapezoidal shape as the inclined portion A6. In the inclined portion A9, a part of side surfaces 69A is cooled using a plurality of cooling flow paths by exposing the cooling air holes 75 at side surfaces 69A. Thus, it can be expected that there will be effects such as better heat resistance (coolability) than that with the inclined portion A8 in FIG. 14 in which the cooling air hole 75 is parallel to the side surfaces 68A.

Although not shown in the drawings, the cooling air holes 75 may be formed in each of the above-described inclined portion A1, A2, A3, A4, and A5.

Also in the modified example of the fourth embodiment, when positions in the radial direction of the outer diameter side leading end portion and the inner diameter side leading end portion of the combustor basket do not vary as in the third embodiment, it is possible to manufacture the combustor basket simply by cutting processing such as laser cutting without performing press working, thereby facilitating the production.

Although the embodiments of the present invention have been described above, various changes to the above-described constitution are possible without departing from the gist of the present invention.

For example, examples in which the inclined portions A (A1, A2, A3, A4, A5, A6, A7, A8, and A9) are formed over the entire region in the circumferential direction of the leading end 41S of the combustor basket 41 (71) have been explained in the above-described embodiments. However, as aspect of the combustor basket 41 is not limited thereto and the inclined portion A may be provided only in a partial region in the circumferential direction at the end portion on the downstream side of the combustor basket 41. Particularly, when a dimension in the radial direction of a gap between the outer circumferential surface of the combustor basket 41 and the inner circumferential surface of the transition piece 42 (a dimension in the radial direction of the combustor axis Ac) is not constant in the circumferential direction of the combustor basket 41, in other words, when a gap between the combustor basket 41 and the transition piece 42 is formed to have a locally large region, it is known that the above-described quenching of flame is easily generated in this region. Therefore, it is possible to more efficiently prevent the generation of the quenching by providing the above-described inclined portion A at least in such a region.

INDUSTRIAL APPLICABILITY

It is possible to reduce an environmental load using the above-described combustor and gas turbine.

REFERENCE SIGNS LIST

1 Compressor
2 Turbine
3 Combustor
3N Fuel nozzle
6 Cooling air passage
11 Compressor rotor
12 Compressor casing
13 Compressor blade cascade
14 Compressor blade
15 Compressor vane cascade
16 Compressor vane
21 Turbine rotor
22 Turbine casing
23 Turbine blade cascade
24 Turbine blade
25 Turbine vane cascade
26 Turbine vane
41, 71 Combustor basket
41S Leading end of combustor basket
42 Transition piece
42D Downstream portion of transition piece
42U Upstream portion of transition piece
51 First nozzles
52 Second nozzle
60A, 61A, 62A, 63A, 64A, 65A, 66A, 68A, 69A Side surface
75 Cooling air hole
91 Gas turbine rotor

92 Gas turbine casing
100 Gas turbine
A, A1, A2, A3, A4, A5, A6, A7, A8, A9 Inclined portion
A1*a* Base portion
A1*b* End portion
Ac Combustor axis
Am Central axis
B Extending portion
C Connection portion
G Generator
P Inclined surface
S1, S11, S12, S13, S14, S15, S16 Inner diameter side leading end portion
S2 Outer diameter side leading end portion
Sp Base end portion
Vc Combustion space
Vg Combustion gas flow path

What is claimed is:

1. A combustor comprising:

a fuel nozzle extending along an axis;

a tubular combustor basket configured to cover the fuel nozzle; and a tubular transition piece into which a leading end portion of the tubular combustor basket is inserted, the tubular transition piece being configured to: (i) define a cooling air passage between the tubular transition piece and an outer circumferential surface of the leading end portion of the tubular combustor basket; and (ii) allow air from outside the tubular combustor basket and the tubular transition piece to be introduced thereinto through the cooling air passage, wherein:

the leading end portion of the tubular combustor basket includes an outer diameter side leading end portion and an inner diameter side leading end portion, the inner diameter side leading end portion being: (i) next to the outer diameter side leading end portion in a circumferential direction; and (ii) further inward in a radial direction than the outer diameter side leading end portion;

an inclined surface is defined between the inner diameter side leading end portion and an inner circumferential surface of the tubular combustor basket;

the inclined surface extends inward in the radial direction as the inclined surface extends from upstream toward downstream relative to a flow direction of the air;

the outer diameter side leading end portion is further upstream relative to the flow direction of the air than the inner diameter side leading end portion;

the tubular combustor basket further includes an inclined portion in which: (i) the inclined surface is defined; and (ii) a leading end downstream relative to the flow direction of the air is the inner diameter side leading end portion; and a width dimension of the inclined portion in the circumferential direction decreases as the inclined portion extends downstream relative to the flow direction of the air.

2. The combustor according to claim 1, further comprising:

a connection portion configured to connect the inner diameter side leading end portion and the outer diameter side leading end portion in the radial direction.

3. The combustor according to claim 1, wherein, in the inclined portion, a surface which faces in the circumferential direction has a curved surface shape.

4. The combustor according to claim 1, wherein, in the inclined portion, the inner diameter side leading end portion has an acute shape.

5. The combustor according to claim 1, wherein the tubular combustor basket has a cooling air hole through which the air from outside the tubular combustor basket and the tubular transition piece is introduced thereinto.

6. A gas turbine comprising:

a compressor;

the combustor according to claim 1; and a turbine, wherein:

the compressor is configured to generate high pressure air;

the combustor is configured to generate a combustion gas by mixing a fuel with the high pressure air and burning the mixture; and the turbine is configured to be driven using the combustion gas.

* * * * *